US007491373B2

(12) United States Patent
Ketcham et al.

(10) Patent No.: US 7,491,373 B2
(45) Date of Patent: Feb. 17, 2009

(54) FLOW-THROUGH HONEYCOMB SUBSTRATE AND EXHAUST AFTER TREATMENT SYSTEM AND METHOD

(75) Inventors: Thomas Dale Ketcham, Big Flats, NY (US); Yuming Xie, Horseheads, NY (US)

(73) Assignee: Corning Incorporated, Corning, NY (US)

( * ) Notice: Subject to any disclaimer, the term of this patent is extended or adjusted under 35 U.S.C. 154(b) by 225 days.

(21) Appl. No.: 11/599,928

(22) Filed: Nov. 15, 2006

(65) Prior Publication Data

US 2008/0110341 A1 May 15, 2008

(51) Int. Cl.

| | |
|---|---|
| ***B01D 53/92*** | (2006.01) |
| ***B01D 53/94*** | (2006.01) |
| ***B01J 35/04*** | (2006.01) |
| ***B32B 3/12*** | (2006.01) |
| ***F01N 3/022*** | (2006.01) |
| ***F01N 3/033*** | (2006.01) |
| ***F01N 3/08*** | (2006.01) |
| ***F01N 3/10*** | (2006.01) |

(52) U.S. Cl. ..... 423/213.2; 423/213.7; 423/215.5; 60/274; 60/282; 60/295; 60/299; 60/302; 502/1; 502/100; 502/300; 502/518; 502/527.19; 55/DIG. 30; 95/273; 95/285; 422/168; 422/180; 428/116; 428/117

(58) Field of Classification Search ..... 423/213.2, 423/213.7, 215.5; 60/274, 282, 295, 299, 60/302; 502/1, 100, 300, 518, 527.19; 55/DIG. 30; 95/273, 285; 422/168, 180; 428/116, 117
See application file for complete search history.

(56) References Cited

U.S. PATENT DOCUMENTS

| | | | | |
|---|---|---|---|---|
| 4,455,180 | A | 6/1984 | Hillman et al. | 156/89 |
| 6,673,414 | B2 | 1/2004 | Ketcham et al. | 428/116 |
| 6,809,139 | B2 | 10/2004 | Fabian et al. | 524/430 |
| 2004/0161373 | A1 | 8/2004 | Ichikawa et al. | 422/180 |
| 2004/0258582 | A1 | 12/2004 | Miwa et al. | 422/177 |
| 2005/0210848 | A1 | 9/2005 | Kuki et al. | 55/523 |
| 2006/0178258 | A1 | 8/2006 | Gadkaree et al. | 501/124 |
| 2008/0110341 | A1 * | 5/2008 | Ketcham et al. | 95/274 |
| 2008/0155952 | A1 * | 7/2008 | Okazaki et al. | 55/523 |

FOREIGN PATENT DOCUMENTS

| | | | |
|---|---|---|---|
| EP | 0480396 | A1 | 10/1991 |
| EP | 1217185 | A2 | 11/2001 |
| EP | 1598534 | A2 | 11/2005 |
| GB | 2342055 | A | 9/1999 |
| JP | 61097037 | | 5/1986 |
| JP | 04-301114 | | 10/1992 |
| JP | 2001263051 | | 9/2001 |

* cited by examiner

*Primary Examiner*—Timothy C Vanoy
(74) *Attorney, Agent, or Firm*—Matthew B. McNutt

(57) ABSTRACT

A system and method including a radially non-uniformly plugged flow-through honeycomb substrate positioned upstream of a wall-flow particulate filter for controlled thermal regeneration of the wall-flow particulate filter, the flow-through honeycomb substrate having a flow-through region including a first portion of parallel channels and a flow-control region including a second portion of parallel channels, the first portion of the parallel channels including unplugged channels and the second portion of the parallel channels including plugged channels, with the flow-control region adjusting flow distribution through the flow-through honeycomb substrate.

28 Claims, 9 Drawing Sheets

FLOW-THROUGH HONEYCOMB SUBSTRATE AND EXHAUST AFTER TREATMENT SYSTEM AND METHOD

BACKGROUND OF THE INVENTION

The invention relates generally to ceramic honeycomb articles, and more particularly to systems and methods for purifying diesel exhaust gases including such honeycomb articles. More specifically, the invention relates to flow-through honeycomb substrates and to methods and systems including combinations of flow-through substrates and wall-flow particulate filters.

Combustion of diesel fuel produces particulates including soot. These particulates are in addition to traditional fuel combustion emissions such as carbon monoxide, hydrocarbons, and nitrogen oxides. Wall-flow particulate filters are often used in diesel engine systems to remove particulates from exhaust gas. These wall-flow particulate filters are typically made of a honeycomb substrate with parallel flow channels and internal porous walls. The flow channels are plugged, usually in a checkerboard pattern, so that exhaust gas, once inside the honeycomb substrate, is forced to pass through the internal porous walls, whereby the porous walls retain a portion of the particulates in the exhaust gas.

Wall-flow particulate filters have been found to be effective in removing particulates from exhaust gas. However, pressure drop across the honeycomb filter increases as the particulates trapped in the porous walls increase. In a diesel-powered vehicle, this increasing pressure drop results in a gradual rise in back pressure against the diesel engine. When the pressure drop across the honeycomb substrate reaches a certain level, the wall-flow particulate filter may be thermally regenerated in-situ. Thermal regeneration involves subjecting the wall-flow particulate filter to a temperature sufficient to fully combust soot.

During thermal regeneration, excessive temperature spikes at various points in the honeycomb filter can occur due to poor control of the thermal regeneration. These excessive temperature spikes may produce thermal stress in the honeycomb filter. If the thermal stress exceeds the internal mechanical strength, the wall-flow particulate filter may crack, which may, in some cases, degrade performance. Therefore, means of better controlling regeneration temperatures in the wall-flow particulate filter during thermal regeneration is desirable.

SUMMARY OF THE INVENTION

In one broad aspect, the invention is an exhaust after treatment system comprising a flow-through honeycomb substrate positioned upstream of a wall-flow particulate filter. The flow-through honeycomb substrate has an inlet face and an outlet face and a plurality of longitudinal cell walls extending between the inlet face and the outlet face. The longitudinal cell walls define a plurality of parallel cell channels extending between the inlet and outlet faces. The flow-through honeycomb substrate has a flow-through region including a first portion of the parallel cell channels, and a flow-control region including a second portion of the parallel cell channels. The first portion of the parallel channels includes unplugged channels wherein flow passes straight through the channels, and the second portion of the parallel channels includes a plugged channels. The plugged cell channels in the flow-control region adjust flow through the honeycomb substrate such that flow having a first flow distribution presented at the inlet face emerges at the outlet face with a second flow distribution that is different than the first flow distribution. In particular, the adjusted flow results from a radial plug density of the plugged channels which is non-uniform. The resultant flow may be, for example, made more uniform than the first flow distribution. Alternatively any desired flow profile may be developed and presented to the downstream particulate filter. Accordingly, radial soot distribution within the downstream wall-flow filter may be controlled.

According to further embodiments of the invention, plugs are distributed in the flow-through honeycomb substrate such that a radial plug density is non-uniform. In more detail, the radial plug density may be non-uniform in relation to a radial centroid of area of the inlet face. According to further embodiments of the invention, the flow-control region may include a higher radial density of plugs than the flow-through region. Certain embodiments include an inner region that includes a relatively higher radial density of plugged cell channels than an outer region located radially outward from the inner region. In another embodiment, an intermediate region includes a relatively higher plug density than regions located radially inward and outward therefrom. In yet other exemplary embodiments, the minimum density of plugs is located other than at the centroid of area. For example, the minimum plug density may be located in an intermediate region in between an inner and outer region. Accordingly, these embodiments modify the flow velocity profile through the honeycomb substrate such that the flow pattern presented to the downstream wall-flow particulate filter includes a desired modified flow velocity profile. For example, the flow velocity profile may include a relatively higher flow velocity level in a radially outward region thereof, as compared to a like flow-through substrate without plugs, i.e., with an unmodified flow profile. Optionally, the maximum flow velocity may coincide with an intermediate region with an annular region of lower flow velocity.

In another broad aspect, the invention is an exhaust system comprising a non-uniformly plugged flow-through honeycomb substrate, and a downstream wall-flow particulate filter. The wall-flow filter is presented with, and receives, a modified flow velocity profile generated from flow initiated through the non-uniformly plugged flow-through honeycomb substrate. In particular, the flow velocity profile through the substrate may be substantially modified, as compared to a like (same cell structure, wall thickness, cell density, etc.) unplugged flow through substrate. The flow velocity profile may be modified, for example, such that high velocity region(s) in the flow profile exiting the flow-through honeycomb substrate are reduced in magnitude, as compared to a system with a like cell structure unmodified flow-through substrate. In other embodiments, the flow velocity profile is modified, by providing suitable plug patterns in the flow through substrate, to provide any desired flow profile at the inlet to the downstream wall-flow filter. In some embodiments, the flow is modified such that relatively more soot is distributed radially outward from the center of area of the wall-flow filter. This may reduce temperature peaks within the filter during active regeneration events.

In yet another broad aspect, the invention is directed to a method of purifying exhaust gas from an internal combustion engine, such as a diesel engine, which comprises directing an exhaust gas at an inlet face of a flow-through honeycomb substrate having a combination of plugged and unplugged (flow-through) channels, wherein the exhaust gas is presented to, and received at, the flow-through honeycomb substrate with a first flow velocity distribution and emerges at an outlet face of the flow-through honeycomb substrate with a second flow velocity distribution that is modified and different than the first flow distribution. The exiting flow velocity distribution may be, for example, more uniform than the received flow velocity distribution. Optionally, the location and number of plugs in the flow-through substrate may be arranged such that any desired flow velocity profile exiting the flow through substrate is achieved. To achieve the desired exiting flow distribution, the density of plugs may be applied to be radially non-uniform. In particular, higher density of plugs in various radial regions may be provided, as measured relative to a plane perpendicular to the flow direction. For example, as shown in FIG. 2A, the plugs 208A may be located only at the outlet end and may be only concentrated at a central radial region (shown inside the circle) whereas an outer radial region (shown outside the circle) surrounding the central region may be unplugged. This radially non-uniform plug density configuration tends to generally make the exiting flow profile from the flow-through honeycomb substrate become more uniform by reducing flow velocities near the center and increasing the flow velocities in radially outward regions. The method of the invention may further include passing the exhaust gas with the second flow distribution through a wall-flow particulate filter located downstream of, and preferably inline with, the flow-through honeycomb substrate. In certain embodiments the wall-flow filter and flow-through substrate are spaced apart. They may be housed within the a common housing or may be included in separate housing units connected by a short transitional pipe section or may be directly connected together without a transitional pipe or space.

According to further embodiments, the invention is a flow-through honeycomb substrate, comprising a honeycomb structure having an inlet face and an outlet face and a plurality of longitudinal cell walls extending between the inlet and outlet faces, said longitudinal cell walls defining a plurality of parallel cell channels extending between the inlet face and the outlet face, said honeycomb substrate having a non-uniform density of plugged cell channels. The radial non-uniformity is measured relative to a radial centroid of area of the honeycomb structure. In a preferred implementation, a ratio of the total number of plugged cell channels to the total number of cell channels is less than or equal to 45%, or even less than or equal to 35%, or even less than or equal to 25%. Some embodiments include a relatively higher density of plugged channels in an inner radial region as compared to other regions located radially outward therefrom. Other plug patterns include an intermediate region with the relatively higher plug density. Additionally, multiple regions of varying plug densities may be provided.

Other features and advantages of the invention will be apparent from the following description and the appended claims.

BRIEF DESCRIPTION OF THE DRAWINGS

The accompanying drawings, described below, illustrate typical embodiments of the invention and are not to be considered limiting of the scope of the invention, for the invention may admit to other equally effective embodiments. The figures are not necessarily to scale, and certain features and certain view of the figures may be shown exaggerated in scale or in schematic in the interest of clarity and conciseness.

DETAILED DESCRIPTION OF THE INVENTION

Figure 1A:
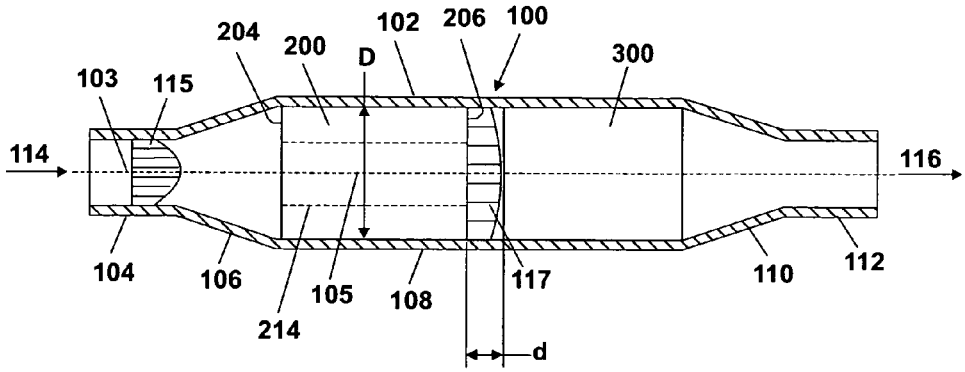
FIGS. 1A and 1B depict cross sectional views of two embodiments of flow-through honeycomb substrates in an exhaust system, the system of FIG. 1A featuring aligned axes and the system of FIG. 1B featuring angularly inclined axes.

The invention will now be described in detail with reference to a few preferred embodiments, as illustrated in the accompanying drawings. In describing the preferred embodiments, numerous specific details are set forth in order to provide a thorough understanding of the invention. However, it will be apparent to one skilled in the art that the invention may be practiced without some or all of these specific details. In other instances, well-known features and/or process steps have not been described in detail so as not to unnecessarily obscure the invention. In addition, like or identical reference numerals are used to identify common or similar elements.

According to embodiments, the invention provides a flow-through honeycomb substrate having longitudinally-oriented through channel cells for passage of exhaust gas. Exhaust gas approaches, and is presented to, the inlet face of the flow-through honeycomb substrate with an incoming flow velocity distribution, passes through the flow-through honeycomb substrate, and exits the flow-through honeycomb substrate with an outgoing flow velocity distribution. The plug pattern in the flow through honeycomb substrate is such that it modifies the flow velocity pattern and flow distribution through the flow-through substrate (as compared to an unplugged flow-through substrate of the same cell structure) such that the outgoing flow velocity distribution is different than the incoming flow velocity profile. In particular, the outgoing flow velocity distribution may be made more uniform than the incoming flow velocity distribution. The invention may achieve the different (e.g., more uniform) outgoing flow velocity distribution by reducing the flow area, by selectively plugging of the flow-through substrate, in a region(s) where a maximum of the incoming flow velocity distribution impinges on the inlet face of the flow-through monolith. The changed or modified flow profile is achieved by non-uniformly plugging the flow-through substrate in the radial direction. In certain embodiments, the interior surfaces of the flow-through honeycomb substrate may include active catalytic species, which would then allow the flow-through substrate of the invention to double up as a flow-through honeycomb substrate catalyst. In particular, the catalysts may be a diesel oxidation catalyst comprising a platinum group metal(s) dispersed on a ceramic support in order to convert both HC and CO gaseous pollutants and particulates, i.e., soot particles, by catalyzing the oxidation of these pollutants to carbon dioxide and water. Such catalysts have generally been contained in units called diesel oxidation catalysts (DOC's) which are placed in the exhaust train of diesel power systems to treat the exhaust before it vents to the atmosphere.

In an exhaust system of the invention including a wall-flow particulate filter, the flow-through honeycomb substrate may be positioned upstream of the wall-flow particulate filter and used to generate and provide a desired, possibly more uniform, flow velocity distribution across the inlet to the wall-flow particulate filter. More uniform flow distribution can promote more uniform distribution of particulates (including soot) inside the wall-flow particulate filter. Relatively more uniform soot distribution in the wall-flow particulate filter may promote more uniform soot combustion within the wall-flow particulate filter. This, in turn, may then reduce or eliminate excessive local temperature spikes that may produce differential thermal stresses in the wall-flow particulate filter during regeneration events. Such differential stresses may cause internal cracking. Accordingly, reductions in thermal stress during regeneration intervals are much sought after.

Figure 1B:
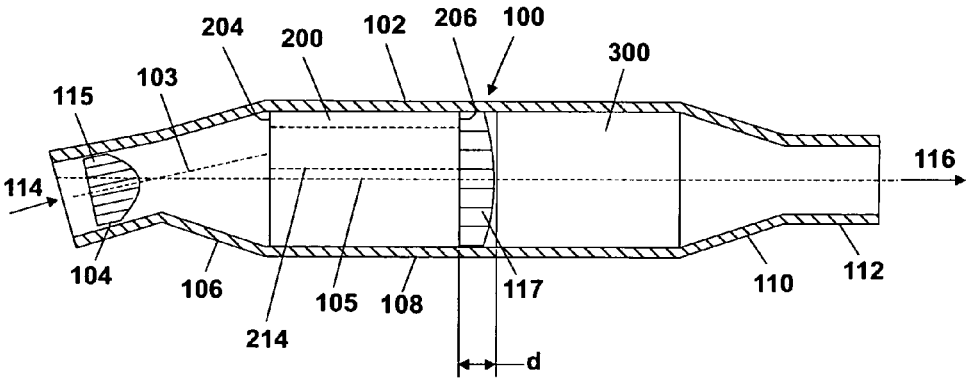
Figure 6:
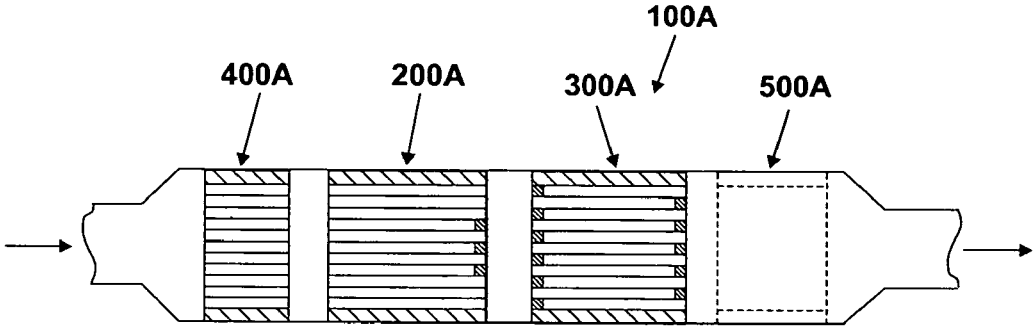
FIGS. 6 and 7 are side view diagrams of systems including the combination of a non-uniformly plugged flow-through honeycomb substrate and wall-flow filter of the invention, FIG. 6 showing a system including optional diesel oxidation catalysts and FIG. 7 showing a system including a flow through substrate and a filter in separate housings.

FIGS. 1A and 1B depict schematically an exhaust after treatment system 100 according to aspects of the invention for processing and venting exhaust gas from an internal combustion engine, such as a diesel engine (not shown). The exhaust after treatment system 100 includes a housing 102, preferably manufactured from a metal, such as steel. In one example, the housing 102 includes an inlet section 104 adapted to interconnect to the engine (not shown), an optional diffuser section 106, a purification section 108, an optional converging section 10, and an outlet section 112, which may be optionally interconnected to a tailpipe (not shown). The exhaust after treatment system 100 includes therein a radially non-uniformly plugged flow-through honeycomb substrate 200 and a wall-flow particulate filter 300, arranged in series orientation. The substrate 200 and the filter 300 are arranged, in an end to end configuration, in a housing 102 and are preferably disposed in the purification section 108. The substrate and filter may be mounted in a mat system(not shown), such as a vermiculite based intumescent mat or a alumina fiber-based non-intumescent mat. An optional exhaust system 100A, such as shown in FIG. 6, may include other devices in addition to the flow through substrate 200A and wall-flow filter 300A which assist in purification of exhaust gas. For example, where the flow-through honeycomb substrate 200A does not incorporate active catalytic species, one or more diesel oxidation catalysts 400A may precede the flow-through honeycomb substrate 200A. In other diesel exhaust after treatment systems, an oxidation catalyst 500A, such as a lean nitrogen oxide ($NO_x$) catalyst or an SCR catalyst, may follow the wall-flow particulate filter 300A. Within the system, the substrate and filter may be either aligned or misaligned. For example, in FIG. 1A, the longitudinal axis 103 of the inlet section 104 is aligned or substantially aligned with the longitudinal axis 105 of the purification section 108. In FIG. 1B, the longitudinal axis 103 of the inlet section 104 is inclined at an angle to the longitudinal axis 105 of the purification section 108.

In FIGS. 1A and 1B, the flow-through honeycomb substrate 200 immediately precedes the wall-flow particulate filter 300 and the longitudinal axis of the flow-through honeycomb substrate 200 is aligned or substantially aligned with the longitudinal axis of the wall-flow particulate filter 300. In addition, the flow-through substrate 200 may be spaced apart longitudinally from the wall-flow particulate filter 300 such that the respective outlet face of the flow through substrate 200 is spaced from the inlet face of the filter 300.

Figure 7:
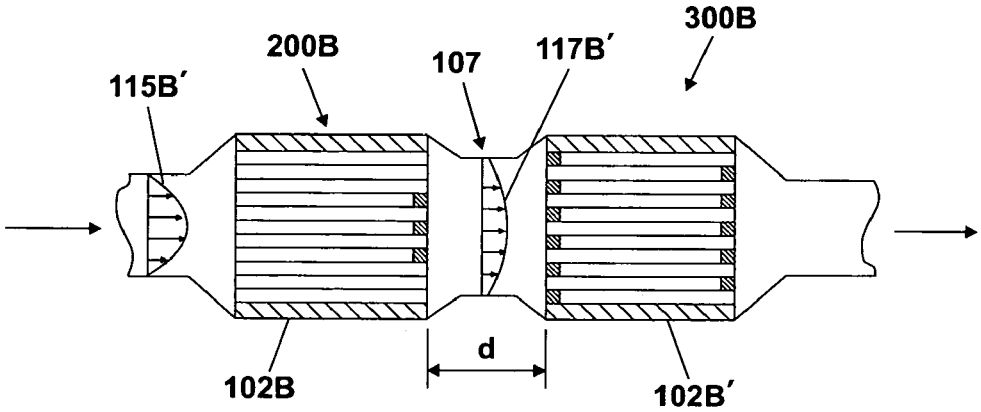

Preferably, the spacing (d) between the opposing faces of the flow-through honeycomb substrate 200 and the wall-flow particulate filter 300 is not so large that the flow velocity profile distribution exiting the flow-through honeycomb substrate 200 has a chance to significantly reform (due to pipe flow) to a comprise a substantially parabolic shape prior to entering the wall-flow particulate filter 300. In one example, the spacing (d) is less than 6 inches (15.2 cm). In another example, the spacing (d) is less than 3 in. (7.6 cm). In yet another example, the spacing (d) is less than (D), the largest diameter of the flow through substrate 200, i.e., d<D. As shown in FIG. 1A, a ratio of D/d may be greater than or equal to 2, or even 3 or even 5 such that the flow profile produced upon exit from the flow-through substrate does not have the opportunity to re-establish a parabolic profile. As is shown in FIG. 7, the flow through substrate 200B and the filter 200B may be included in separate housings 102B, 102B' interconnected by a smaller-dimension short transition section 107 so long as the spacing (d) is sufficiently short such that the benefit of the modified flow profile is not lost due to having a reestablished profile. In other words, the velocity profiles 115B', 117B' are substantially different and have the desired profile shape.

Again referring to FIG. 1A, the diameter of the flow-through honeycomb substrate 200 may be the same as, or may be larger than, the diameter of the wall-flow particulate filter 300. Both the flow-through honeycomb substrate 200 and the wall-flow particulate filter 300 include honeycomb substrates having channels, as will be further explained below. The cell densities of the flow-through honeycomb substrate 200 and the wall-flow particulate filter 300 may or may not be the same, where cell density is the number of channels per cross-sectional area of the honeycomb substrate.

Figure 2A:
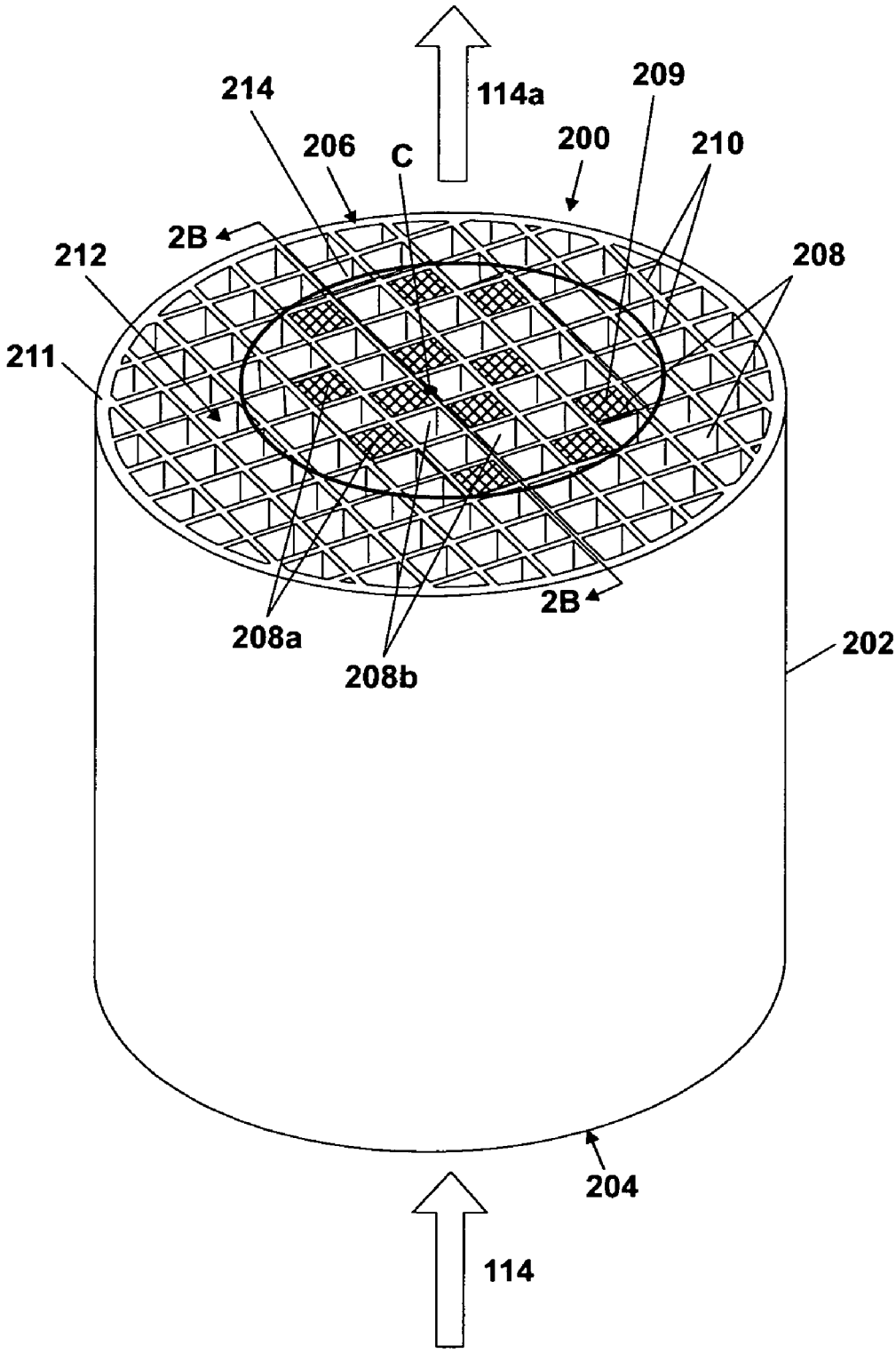
FIG. 2A is a perspective view of the flow-through honeycomb substrate depicted in FIG. 1A and illustrating a non-uniform plug density.
Figure 2B:
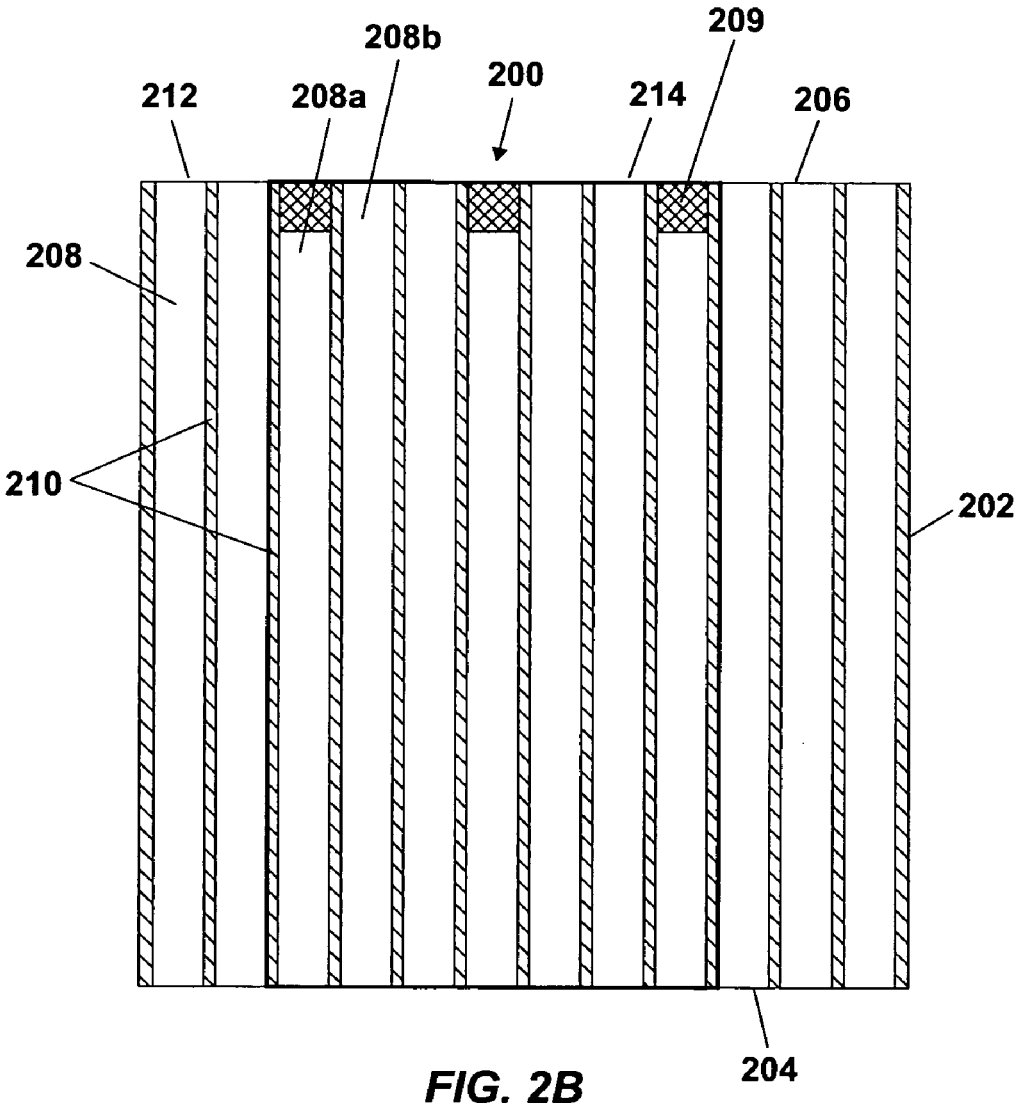
FIG. 2B is a vertical cross-section of the flow-through honeycomb substrate depicted in FIG. 2A.

FIGS. 2A and 2B depict the flow-through honeycomb substrate 200 in perspective view and cross-sectional view, respectively. The flow-through honeycomb substrate 200 includes a honeycomb substrate structure 202, which may be made by extrusion using, for example, using any known plasticized ceramic precursors materials. Upon firing, a ceramic is formed such as cordierite, aluminum titanate, or silicon carbide for example. Although not shown, the honeycomb substrate structure 202 may be disposed within a metal sleeve prior to inserting the flow-through honeycomb substrate 200 in the housing (102 in FIG. 1A or 1B) and may also be encircled by an resilient mat sandwiched between the skin 211 and the sleeve, as discussed above. The honeycomb substrate structure 202 may be columnar in shape. The traverse cross-sectional shape of the honeycomb structure 202 may be circular, elliptical, square, rectangular or may have other suitable geometrical shape for the application. The honeycomb substrate structure 202 has an inlet face 204 and an outlet face 206, where the inlet face 204 opposes the outlet face 206 and has parallel channels 208 extending from the inlet face 204 to the outlet face 206 along the longitudinal length thereof. The channels 208 are defined by a plurality of intersecting longitudinal cell walls 210 extending from the inlet face 204 to the outlet face 206. Flow 114 having a first flow distribution is received at the inlet face 204. The flow passes through the honeycomb substrate 200 through the through channels 208 to the outlet face 206 and is thus modified. Flow 114*a* having a second flow velocity distribution exits the honeycomb substrate 200 through the outlet face 206. The non-uniform radial plug density of the plugged channels causes a redistribution of the radial flow velocities (as compared to an unplugged flow through substrate).

The intersecting walls 210 of the honeycomb substrate 202 defining the channels 208 are preferably porous, and exemplary embodiments exhibit a total porosity of less than 65%, or even between about 20% and 55%, or even between 25% and 40%. Mean pore size of the walls may be between 1 μm and 15 μm, or even between 5 μm and 10 μm. CTE is preferably between $1.0\times10^{-7}$/° C. up to about $9\times10^{-7}$/° C. measured between 25° C. and 800° C. The walls 210 may or may not carry active catalytic species, such as oxidation catalytic species. Where the walls 210 carry active catalytic species, the active catalytic species may be provided in a porous wash coat applied on the walls 210 or otherwise incorporated on the walls 210. Where wash coated, the wash coat may include a material such as alumina, zirconia, or ceria. The flow-through honeycomb substrate 200 may incorporate any known active catalytic species for purifying exhaust gas, such as oxidation catalytic species for reducing carbon monoxide, hydrocarbons, and soluble organic fraction of particulates. The catalyst can be any type of oxidation catalyst, including PGM (mainly Pt, Pd, Rh or $RuO_2$) or other types of mixed oxide catalysts, such as perovskite, oxygen storage materials, and supported metal catalysts.

The flow-through honeycomb substrate 200 of the invention includes a flow-through region 212 and a flow-control region 214 (inside the illustrative circle). In this embodiment, none of the channels 208 are plugged in the flow-through region 212, and exhaust gas passes straight through the unplugged channels. In the flow-control region 214 of this embodiment, a first set 208*a* of the channels 208 are plugged, while a second set 208*b* of the channels 208 are unplugged, and exhaust gas does not pass through (or is significantly restricted through) the plugged channels 208*a* but only passes through the unplugged channels 208*b*. The channels 208*a* may be plugged by inserting filler material 209 at one or both ends of the channels 208*a* or somewhere within the channel 208*a* along the length. Optionally, the channel may be completely filled. To avoid creating large turbulences at the inlet face 204, the filler material 209 is preferably inserted in the plugged channels 208*a* at or near the outlet face 206. In this case, the plugged channels 208*a* may also serve to collect some particulates from the exhaust gas. The unplugged channels 208*b* in the flow-control region 214 and the unplugged channels 208 in the flow-through region do not contain filler material.

The plugged channels 208*a* have the effect of reducing the flow area in the flow-control region 214 and, thus, add a flow restriction in the flow control area. This redirects flow from the flow-control region 214 to and through the flow-through region 212. Accordingly, this modifies the flow velocity profile exiting the flow through honeycomb substrate. This may be used to produce a more uniform flow distribution exiting the outlet face 206 of the flow-through honeycomb substrate 200.

Figure 4A:
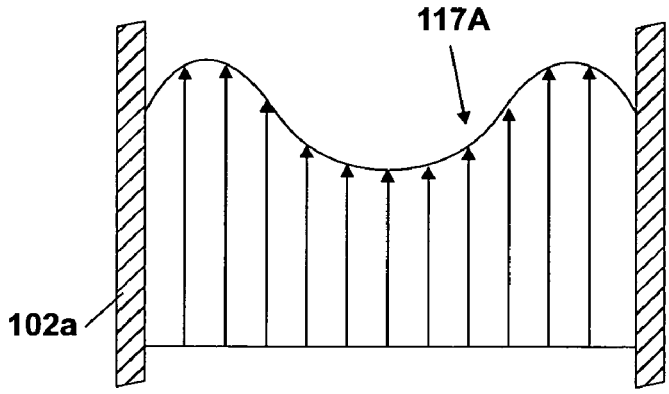
FIG. 4A-4C are graphical depictions of various non-uniform flow velocity profiles produced by the present invention at the exit of the flow-through honeycomb substrate, FIG. 4A illustrating a profile with peak flow velocity intermediate a centerline and a wall, FIG. 4B illustrating a profile with peak flow velocity adjacent a wall, and FIG. 4C illustrating a profile with a minimum flow velocity intermediate a centerline and a wall.
Figure 4B:
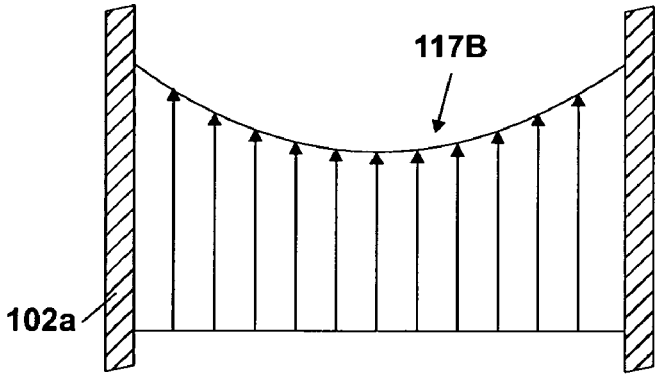
Figure 4C:
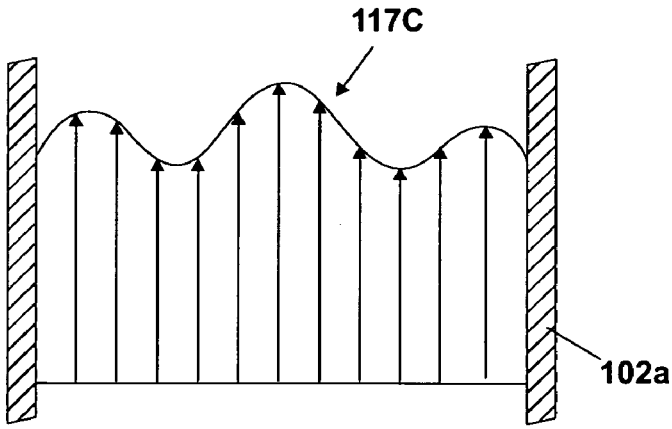

FIGS. 1A and 1B show the less uniform (higher peak) flow distribution 115 passing through the inlet section 104 to the inlet face 204 of the flow-through honeycomb substrate 200 and the more uniform flow distribution 117 emerging at the outlet face 206 of the flow-through honeycomb substrate 200 as a result of the non-uniform plugging. In this embodiment, the flow-control region 214 is located in the flow-through honeycomb substrate 200 where the maximum amplitude of the incoming flow velocity distribution 115 would impinge (if not plugged) on the inlet face 204 of the flow-through honeycomb substrate 200. However, it should be recognized that the invention may be use various non-uniform plugging patterns on the flow-through honeycomb substrate 200 to effectuate various desirable flow exit profiles, for example the exit flow profiles as shown in FIG. 4A-4C.

Returning to FIG. 2A, within the flow-control region 214, the pattern and number of the plugged channels 208*a* may be variable and would depend on the distribution of the flow impinging on the inlet face 204 of the honeycomb substrate 202. For example, in one embodiment, the plugged channels 208*a* may be distributed substantially uniformly within the flow-control region. The location of the flow-control region 214 in the honeycomb substrate 202 can also be variable, its location depending on the distribution of the flow impinging on the inlet face of the honeycomb substrate 202. In general, flow modeling may be used to determine the profile of the incoming flow velocity distribution, and the optimum location of the flow-control region 214 in the flow-through honeycomb substrate 200. Additionally, where the incoming flow distribution has more than one maximum, the flow-through honeycomb substrate 200 may include more than one flow-control region 214 to achieve a more uniform flow distribution across the outlet face 206 of the flow-through honeycomb substrate 200.

Outside the flow control region, i.e., in the flow-through region 212, the density of plugged channels is less than in the flow control region 214, thereby resulting in a radially non-uniform plug density. The flow through regions may be placed in the structure at any location where it is desired to locally increase the flow.

It should be recognized that the plugging of the channels in the flow-control regions(s) may be accomplished by any know plugging means, such as by applying a thin transparent mask, laser cutting holes in the cell channels to be plugged, and injecting plugging cement into the cells to a desired depth, such as between about 3 to 25 mm. Any suitable plugging material may be used, such as taught and described in U.S. patent application Ser. No. 11/486,699 dated Jul. 14, 2006 and entitled "Plugging Material For Aluminum Titanate Ceramic Wall Flow Filter Manufacture," WO 2005/051859, WO/074599, U.S. Pat. No. 6,809,139, and U.S. Pat. No. 4,455,180, for example.

Figure 2C:
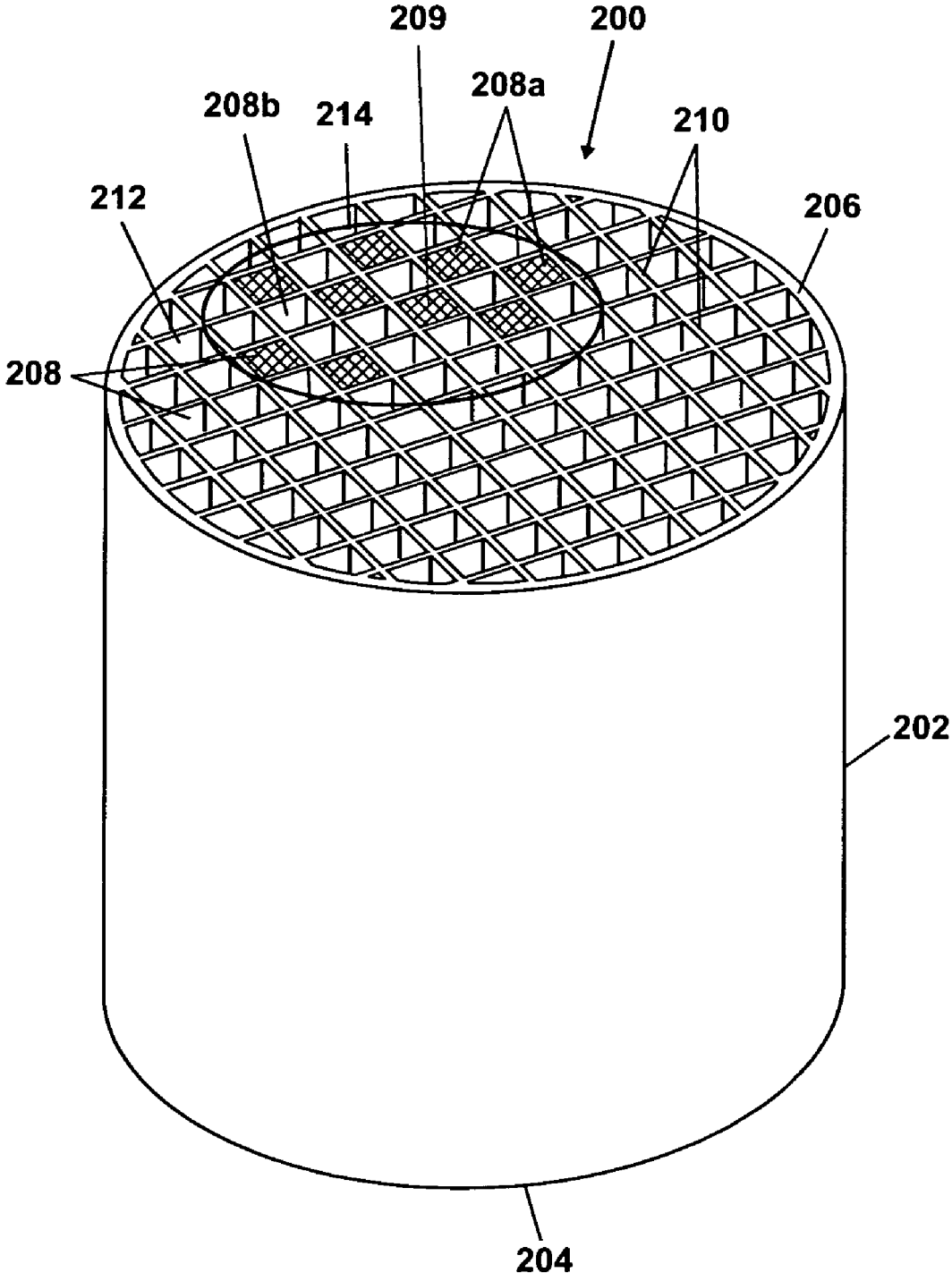
FIG. 2C is a perspective view of the flow-through honeycomb substrate depicted in FIG. 1B and illustrating a non-uniform plug density.

Two different locations for the flow-control region 214 are illustrated in FIGS. 2A and 2C. In FIG. 2A, the center of the flow-control region 214 coincides with, and is substantially centrally oriented with respect to, the centroid of area (C) of the honeycomb substrate 202. This location of the flow-control region 214 is suitable where the maximum of the incoming flow distribution impinges on the center of the inlet face 204 of the honeycomb substrate 202. This may be the case, for example, with the exhaust system depicted in FIG. 1A, where the longitudinal axis 103 of the inlet section 104 is substantially aligned with the longitudinal axis 105 of the flow-through substrate 200. In contrast, in FIG. 2C, the center of the flow-control region 214 is offset from the center of the honeycomb substrate 202. This location of the flow-control region 214 is suitable where the maximum of the incoming flow distribution does not impinge on the center of the inlet face 204 of the honeycomb substrate 202. This may be the case, for example, with the exhaust system depicted in FIG.

1B, where the longitudinal axis 103 of the inlet section 104 is inclined to the longitudinal axis 105 of the flow-through substrate 200.

Figure 3:
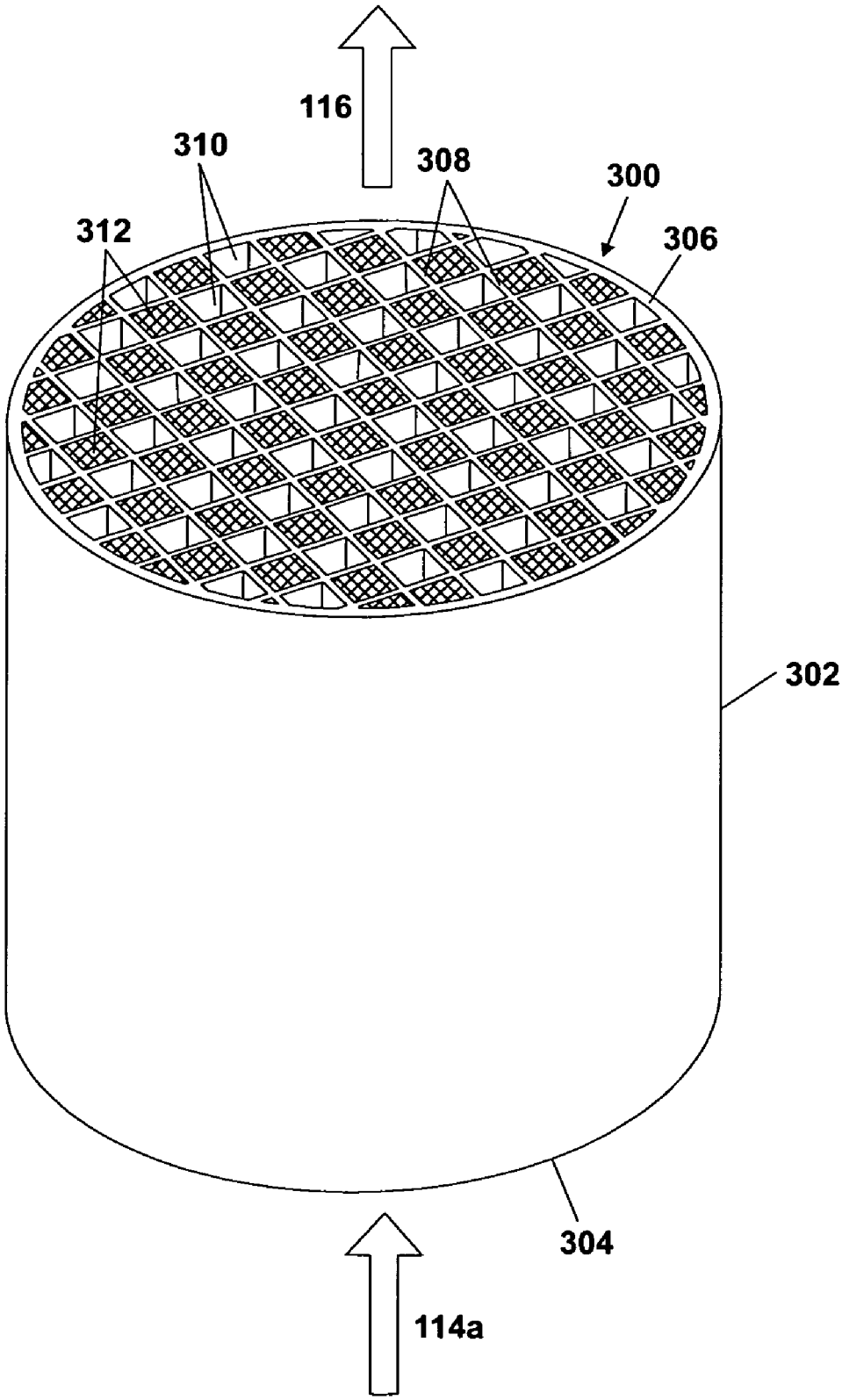
FIG. 3 is a perspective view of a wall-flow particulate filter illustrating plugs in at least one end.

In the system, the wall-flow particulate filter (300 in FIG. 1A or 1B) can be of any conventional construction. For example, as shown in FIG. 3, the wall-flow particulate filter 300 may have a honeycomb structure 302 with opposite end faces 304, 306 and interior porous walls 308 extending between the end faces 304, 306, where the interior porous walls 308 define parallel channels 310 within the honeycomb structure 302. The channels 310 may be end-plugged with filler material 312 in a checkerboard pattern on the end faces 304, 306. It is preferred that the wall-flow particulate filter 300 does not have unplugged channels as in the case of the flow-through monolith (200 in FIGS. 2A-2C) because unplugged channels in the wall-flow particulate filter would allow exhaust gas to escape without being filtered.

The honeycomb structure 302 of the filter may be made by extrusion from, for example, ceramic batch precursors and forming aids and fired to produce ceramic honeycombs of cordierite, aluminum titanate, or silicon carbide. The plugging material 312 for plugging the channels 310 may also include any suitable ceramic forming material, such as a cordierite- or aluminum titanate-based composition as described above, with CTE generally closely matched to the CTE of the honeycomb structure. For passive regeneration, the porous walls 308 of the filter may include active catalytic species. Further, an oxidative catalyst, such as a lean $NO_x$ catalyst 500A, may be added to the system at one of the end faces of the wall-flow particulate filter 300A such as shown in FIG. 6.

For diesel exhaust purification, the porous walls 308 of the filter 300 may incorporate pores having mean diameters in the range of 1 to 60 μm, more typically in the range of 10 to 50 μm, or even 10 to 25 μm, and the honeycomb substrate 302 may have a cell density between approximately 10 and 300 cells/in$^2$ (1.5 and 46.5 cells/cm$^2$), more typically between approximately 100 and 200 cells/in$^2$ (15.5 and 31 cells/cm$^2$). The thickness of the porous walls 308 may range from approximately 0.002 in. to 0.060 in. (0.05 mm to 1.5 mm), more typically between approximately 0.010 in. and 0.030 in. (0.25 mm and 0.76 mm). The channels 310 may have a square cross-section or other type of cross-section, e.g., triangle, rectangle, octagon, hexagon or combinations thereof.

Returning to FIG. 1A or 1B, in operation exhaust gas 114 from an internal combustion engine, for example, a diesel engine, is received in the inlet section 104. The exhaust gas 114 passes through the inlet section 104 with a non-uniform flow distribution 115, passes through the diffuser section 106, and enters the flow-through monolith 200. Where the flow-through honeycomb substrate 200 includes active catalytic species, various oxidation processes may occur while the exhaust gas 114 flows through the flow-through honeycomb substrate 200. The exhaust gas 114 exits the flow-through honeycomb substrate 200 with a flow distribution 117 which is different than when it entered, and may be more uniform. The exhaust gas 114 with the more uniform flow distribution 117 enters the wall-flow particulate filter 300 and is forced through the interior porous walls in the wall-flow particulate filter 300. A portion of the particulates in the exhaust gas 114 is trapped in the porous walls. The filtered exhaust gas 116 exits the wall-flow particulate filter 300, passes through the converging section 110, and exits the exhaust system 100 through the outlet section 112.

Additionally, as shown in FIGS. 4A-4C, several flow profiles are shown which exhibit a non-uniform flow velocity profile that may result upon exit from the outlet face of the non-uniformly plugged flow-through honeycomb substrate 200. FIG. 4A and FIG. 4B illustrate flow velocity profiles 117A, 117B where the flow velocity at the centermost portion of the profile is less than at other points in the profile, for example. FIG. 4A illustrates a profile 117A where the peak flow velocity is located neither at the wall 102*a* of the exhaust pipe 102 or at the centerline thereof. Similarly, FIG. 4B illustrates a flow velocity profile 1171B where the maximum flow velocity is not at the centerline of the exhaust pipe, but is adjacent the outer wall 102*a*. FIG. 4C illustrates a flow velocity profile 117C where the minimum flow velocity occurs in an intermediate region between the center and the wall 102*a*.

Figure 5A:
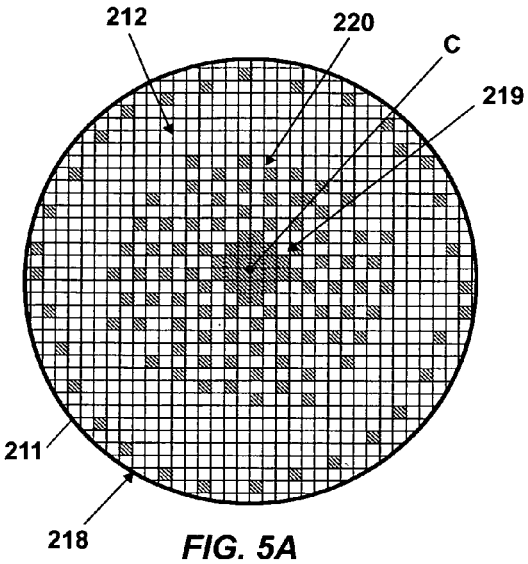
FIG. 5A-5F are end views of the flow-through honeycomb substrates illustrating various non-uniform plug configurations according to embodiments of the present invention, FIG. 5A featuring a central region of high plug density and intermediate and peripheral regions of lower plug density, FIG. 5B featuring a central region of high plug density and a surrounding region of lower plug density, FIG. 5C featuring high plug density in a surrounding region, FIG. 5D featuring a region of high density between inner and outer flow through regions FIG. 5E featuring a first plug configuration for a non-round oval honeycomb substrate, and FIG. 5F featuring a second plug configuration for a non-round honeycomb substrate.
Figure 5B:
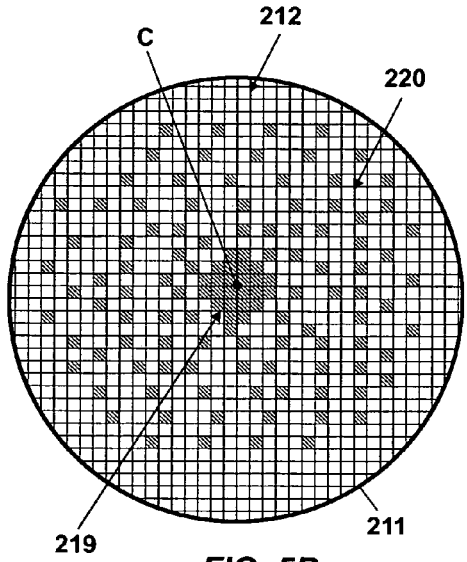
Figure 5C:
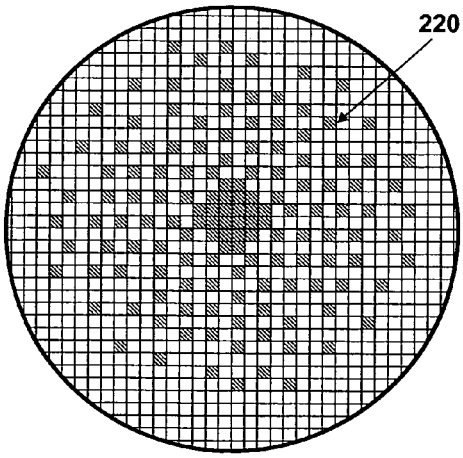
Figure 5D:
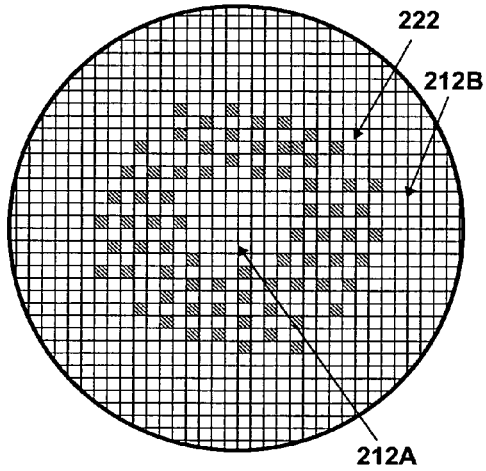
Figure 5E:
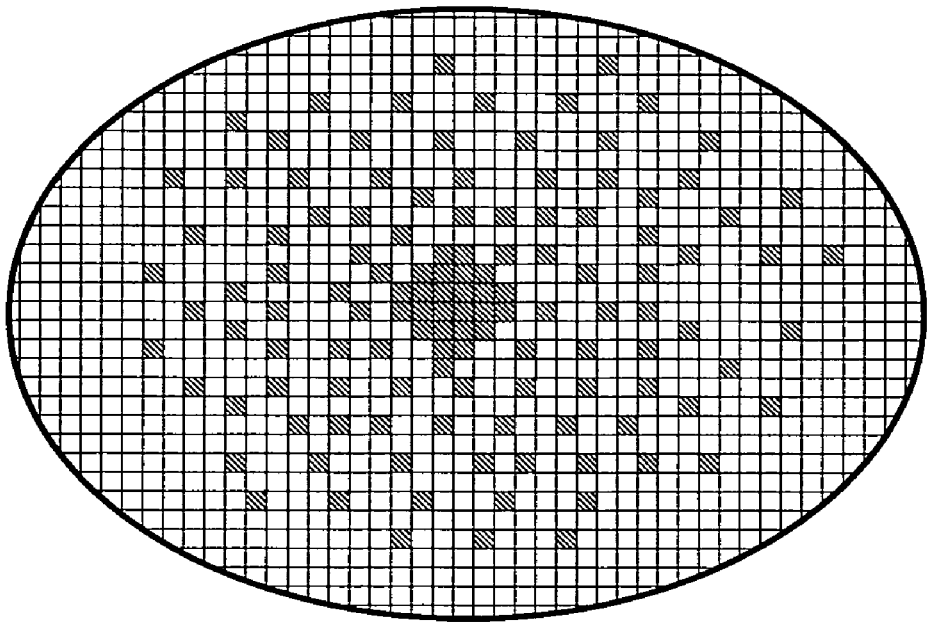
Figure 5F:
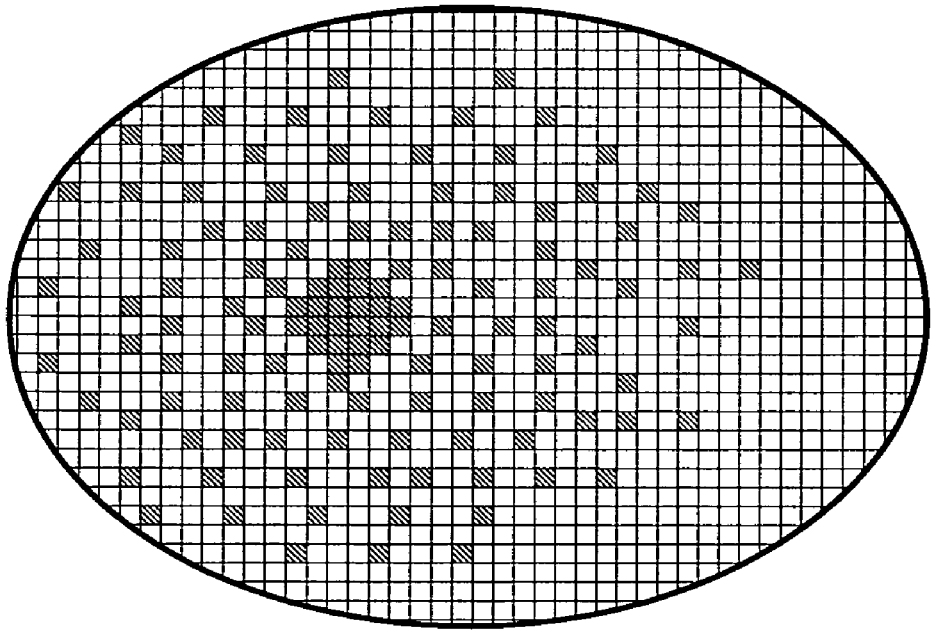

FIGS. 5A-5F illustrate various radially non-uniform plug density patterns according to the invention. FIGS. 5B and 5C, for example, illustrate several embodiments of plugging patterns which result in a modified flow pattern such as shown in FIG. 4B. The pattern of FIG. 5A, which includes a relatively higher density of plugs in a central region 219 located at the centroid of area C, a relatively lower density region 220 surrounding the central region, and another relatively lower density plugged region in an outer region 218 adjacent the outer periphery skin 211. An unplugged flow-through region 212 is included between flow control regions 218, 220. The unplugged region may include an annular region outside of the flow-control region which is devoid of plugs. FIG. 5B includes a central region 219 of relatively high density and a surrounding region 220 of relatively lower plug density and an flow-through region 212 adjacent to the skin 211. FIG. 5C is of a similar design as FIG. 5B, but includes a higher plug density in the surrounding region 220. The embodiment of FIG. 5D includes an intermediate flow-control region 222 of relatively higher density between inner and outer flow through regions 212A, 212B. This non-uniform plug pattern of FIG. 5D may produce a flow velocity profile such as shown in FIG. 4C, for example. Other plug patterns may be employed based upon the flow dynamics of the system to accomplish the desired soot loading distribution within the filter.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An exhaust after treatment system, comprising:

a wall-flow particulate filter, and a flow-through honeycomb substrate positioned upstream of the wall-flow particulate filter, the flow-through honeycomb substrate having an inlet face and an outlet face and a plurality of longitudinal walls extending between the inlet face and the outlet face, said walls defining a plurality of parallel channels extending between the inlet face and the outlet face, said flow-through honeycomb substrate having a flow-through region including a first portion of the parallel channels and a flow-control region including a second portion of the parallel channels, wherein the first portion of the parallel channels includes unplugged channels and the second portion of the parallel channels includes plugged channels wherein a radial plug density of the plugged channels is non-uniform.

2. The system of claim 1, wherein the flow control region includes a combination of plugged and unplugged channels and adjusts flow through the substrate such that flow having a first flow distribution presented at the inlet face emerges at the outlet face with a second flow distribution different than the first flow distribution.

3. The system of claim 1, wherein the second flow distribution is more uniform than the first flow distribution.

4. The system of claim 1, wherein the second flow distribution includes a peak flow velocity located other than at a center of the second flow distribution.

5. The system of claim 1, wherein the flow-control region is located where a maximum flow velocity of the first flow distribution would impinge on the inlet face.

6. The system of claim 5, wherein a center of the flow-control region coincides substantially with a center of the honeycomb substrate.

7. The system of claim 5, wherein a center of the flow-control region is offset from a center of the honeycomb substrate.

8. The system of claim 1, wherein a ratio of plugged area to the total cell area of the flow-through honeycomb substrate is less than 45%.

9. The system of claim 8, wherein the ratio is less than or equal to 35%.

10. The system of claim 8, wherein the ratio is less than or equal to 25%.

11. The system of claim 1, wherein a distribution of plugs in the honeycomb substrate is non-uniform relative to a centroid of area of the honeycomb substrate.

12. The system of claim 11, wherein the distribution of plugs further comprises a relatively lower plug density at positions spaced from the centroid of area.

13. The system of claim 1, wherein the distribution of plugs further comprises an annular region outside of the flow-control region which is devoid of plugs.

14. The system of claim 1, wherein the flow-through honeycomb substrate and the wall-flow particulate filter are disposed in a common exhaust housing.

15. The system of claim 1, wherein the flow-through honeycomb substrate is catalyzed.

16. The system of claim 1, wherein a distance (d) between the outlet face of the flow-through honeycomb substrate and an inlet face of the wall-flow particulate filter is such that the second flow distribution is not substantially altered prior to being received in the wall-flow particulate filter.

17. The system of claim 16, wherein the distance is less than 6 inches.

18. The system of claim 16, wherein the distance (d) is less that a maximum dimension (D) of the flow-through substrate.

19. The system of claim 18, wherein a ratio of dimension (D) divided by distance (d) is greater than 2.

20. A method of purifying exhaust gas from an internal combustion engine, comprising the steps of:

directing an exhaust gas at an inlet face of a flow-through honeycomb substrate having a combination of plugged and unplugged channels and radially non-uniform plug density, wherein the exhaust gas is presented to the flow-through honeycomb substrate with a first flow distribution and emerges at an outlet face of the flow-through monolith with a second flow distribution that is different than the first flow distribution; and passing the exhaust gas with the second flow distribution through a wall-flow particulate filter inline with the flow-through honeycomb substrate.

21. A flow-through honeycomb substrate, comprising:

a honeycomb structure having an inlet face and an outlet face and a plurality of longitudinal walls extending between the inlet face and the outlet face, said longitudinal walls defining a plurality of parallel cell channels extending between the inlet face and the outlet face, said honeycomb substrate having a radially non-uniform density of plugged cell channels and including at least some non-plugged channels.

22. A flow-through honeycomb substrate of claim 21 wherein the radially non-uniform density of plugged cells is relative to a radial centroid of area of the honeycomb structure and wherein a ratio of the plugged cell channels to the total number of cell channels is less than or equal to 45%.

23. A flow-through honeycomb substrate of claim 22 wherein the ratio of the plugged cell channels to the total number of cell channels is less than or equal to 35%.

24. A flow-through honeycomb substrate of claim 22 wherein the ratio of the plugged cell channels to the total number of cell channels is less than or equal to 25%.

25. A flow-through honeycomb substrate of claim 21 wherein the longitudinal walls of the honeycomb structure include a diesel oxidation catalyst.

26. A flow-through honeycomb substrate of claim 21 wherein the radially non-uniform density varies from a region of relatively higher plug density adjacent a radial centroid of area to a relatively lower plug density adjacent an outer periphery of the honeycomb structure.

27. A flow-through honeycomb substrate of claim 21 further comprising an intermediate region located between a radial centroid of area and a periphery of the honeycomb structure wherein the plug density of the intermediate region is relatively lower than regions radially inward and outward therefrom.

28. A flow-through honeycomb substrate of claim 21 further comprising an intermediate region located between a radial centroid of area and an outer periphery wherein the plug density of the intermediate region is relatively higher than regions radially inward and outward therefrom.

* * * * *